US010518190B2

(12) United States Patent
Rosen et al.

(10) Patent No.: US 10,518,190 B2
(45) Date of Patent: Dec. 31, 2019

(54) ROD-SHAPED MODULE FOR TOY MAGNETIC CONSTRUCTION KITS AND METHOD FOR MAKING SAME

(71) Applicant: LaRose Industries, LLC, Randolph, NJ (US)

(72) Inventors: Lawrence Rosen, Mendham, NJ (US); Parviz Daftari, Summit, NJ (US)

(73) Assignee: LaRose Industries, LLC, Randolph, NJ (US)

( * ) Notice: Subject to any disclaimer, the term of this patent is extended or adjusted under 35 U.S.C. 154(b) by 0 days.

(21) Appl. No.: 15/898,029

(22) Filed: Feb. 15, 2018

(65) Prior Publication Data

US 2018/0229144 A1 Aug. 16, 2018

Related U.S. Application Data

(60) Provisional application No. 62/459,238, filed on Feb. 15, 2017.

(51) Int. Cl.

| | |
|---|---|
| ***A63H 33/04*** | (2006.01) |
| ***A63H 33/26*** | (2006.01) |
| ***A63H 33/06*** | (2006.01) |

(52) U.S. Cl.

CPC ..... *A63H 33/046* (2013.01); *A63H 33/06* (2013.01); *A63H 33/26* (2013.01)

(58) Field of Classification Search

CPC ..... A63H 33/046; A63H 33/26; A63H 33/04; A63H 33/06; A63F 2003/0063

See application file for complete search history.

(56) References Cited

U.S. PATENT DOCUMENTS 2,970,388 A * 2/1961 Yonkers ..... A63H 33/046 403/171

3,195,266 A 7/1965 Onanian (Continued)

FOREIGN PATENT DOCUMENTS

| | | |
|---|---|---|
| CN | 2623307 | 7/2004 |
| DE | 3910304 | 10/1990 |

(Continued)

OTHER PUBLICATIONS

Smartmax General Instructions, Smart—Belgium, Brochure with copyright date of 2003-2015.

(Continued)

*Primary Examiner* — Melba Bumgarner
*Assistant Examiner* — Amir A Klayman
(74) *Attorney, Agent, or Firm* — Greenberg Traurig, LLP

(57) ABSTRACT

A module for a toy construction kit includes an elongated, monolithic body made from a non-magnetic material and having a central section, a pair of opposed ends, and a pair of tapered neck sections, one of which is positioned between the central section and one end of the body and the other of which is positioned between the central section and the other end of the body. One end of the body is at least partially covered by a pair of dome-shaped shells positioned on opposed sides thereof. The other end of the body is at least partially covered by another pair of dome-shaped shells positioned on diametrically opposed sides thereof. Each one of the shells is made from a magnetic material and is provided with a receptacle for receiving a plug of the non-magnetic material which forms a corresponding end of the body to thereby secure the shells to the body when the body and shells are integrated by way of a co-molding process.

14 Claims, 2 Drawing Sheets

(56) References Cited

U.S. PATENT DOCUMENTS

| | | | | |
|---|---|---|---|---|
| 3,564,758 | A | 2/1971 | Willis | |
| 3,604,145 | A | 9/1971 | Zimmerman | |
| 3,991,511 | A | 11/1976 | McAllister et al. | |
| 4,726,588 | A * | 2/1988 | Caprio | A63F 7/0088 200/404 |
| 5,575,701 | A | 11/1996 | Hantman | |
| 5,683,283 | A | 11/1997 | Glynn | |
| 5,788,555 | A | 8/1998 | Glynn | |
| 5,823,531 | A | 10/1998 | Huber | |
| 5,938,498 | A | 8/1999 | Glynn | |
| 6,566,992 | B1 * | 5/2003 | Vicentelli | G09B 1/38 335/285 |
| 6,626,727 | B2 * | 9/2003 | Balanchi | A63H 33/046 273/157 R |
| 6,749,480 | B1 * | 6/2004 | Hunts | A63H 33/046 446/85 |
| 6,846,216 | B1 * | 1/2005 | Balanchi | A63H 33/046 273/157 R |
| 6,963,261 | B2 | 11/2005 | Vicentelli | |
| 6,969,294 | B2 | 11/2005 | Vicentelli | |
| 7,154,363 | B2 | 12/2006 | Hunts | |
| 7,160,170 | B2 | 1/2007 | Yoon | |
| 7,234,986 | B2 | 6/2007 | Kowalski et al. | |
| 7,276,270 | B2 * | 10/2007 | Vicentelli | A47F 5/14 248/309.4 |
| 7,364,487 | B2 | 4/2008 | Evans et al. | |
| 7,371,147 | B2 | 5/2008 | Tusacciu | |
| 7,413,493 | B2 * | 8/2008 | Toht | A63H 33/046 273/156 |
| 7,666,054 | B2 | 2/2010 | Glickman et al. | |
| 7,758,398 | B2 | 7/2010 | Park | |
| 7,955,155 | B2 | 6/2011 | Tremblay et al. | |
| 7,988,518 | B2 * | 8/2011 | Kim | A63H 33/046 446/129 |
| 8,016,636 | B2 | 9/2011 | Park | |
| 8,070,550 | B2 * | 12/2011 | Song | A63H 33/046 446/129 |
| 8,128,452 | B2 * | 3/2012 | Kim | A63H 33/046 446/129 |
| 8,292,687 | B2 | 10/2012 | Tremblay et al. | |
| 8,303,366 | B2 | 11/2012 | Tremblay et al. | |
| 8,458,863 | B2 | 6/2013 | Hunts | |
| 8,529,311 | B2 | 9/2013 | Tremblay et al. | |
| 8,911,276 | B2 | 12/2014 | Kim et al. | |
| 9,022,829 | B2 | 5/2015 | Rosen et al. | |
| 9,457,288 | B2 * | 10/2016 | Choi | A63H 33/084 |
| 9,669,324 | B2 | 6/2017 | Roth et al. | |
| 9,694,298 | B2 * | 7/2017 | Cheung | A63H 3/04 |
| 9,873,061 | B2 * | 1/2018 | Cheung | A63H 33/046 |
| 9,980,405 | B2 * | 5/2018 | Hu | H05K 7/023 |
| 10,080,977 | B2 | 9/2018 | Rosen et al. | |
| 2003/0007829 | A1 | 1/2003 | Huang | |
| 2004/0043164 | A1 * | 3/2004 | Vicentelli | A47F 5/14 428/34.1 |
| 2005/0124259 | A1 | 6/2005 | Tusacciu | |
| 2005/0159076 | A1 * | 7/2005 | Kowalski | A63H 33/26 446/137 |
| 2006/0014467 | A1 * | 1/2006 | Tusacciu | A63H 33/046 446/126 |
| 2010/0323700 | A1 * | 12/2010 | Bachmann | H04W 36/0066 455/436 |
| 2012/0131878 | A1 | 5/2012 | Ivanov | |
| 2013/0111710 | A1 | 5/2013 | Hunts | |
| 2013/0165012 | A1 | 6/2013 | Klauber et al. | |
| 2015/0258461 | A1 | 9/2015 | Balanchi | |
| 2016/0074766 | A1 | 3/2016 | Choi | |
| 2018/0126294 | A1 | 5/2018 | Rosen et al. | |

FOREIGN PATENT DOCUMENTS

| | | |
|---|---|---|
| DE | 60206475 | 5/2006 |
| EP | 1348473 | 1/2003 |
| EP | 2590183 | 5/2013 |
| JP | H0780156 | 3/1995 |
| JP | 2002-159761 | 6/2002 |
| JP | 2003-190663 | 7/2003 |
| KR | 100720691 | 5/2007 |
| KR | 101684922 | 12/2016 |
| WO | 1999060583 | 11/1999 |
| WO | 2002055168 | 7/2002 |
| WO | 2005068037 | 7/2005 |
| WO | 2006044613 | 4/2006 |
| WO | 2006057471 | 6/2006 |
| WO | 2006095940 | 9/2006 |
| WO | 2006112679 | 10/2006 |
| WO | 2009007829 | 1/2009 |
| WO | 2011143019 | 11/2011 |
| WO | 2018129380 | 7/2018 |
| WO | 2018152361 | 8/2018 |

OTHER PUBLICATIONS

U.S. Appl. No. 29/594,094, filed Feb. 15, 2017, entitled "Toy Construction Elements".

Office Action dated Jul. 2, 2018, U.S. Appl. No. 15/863,590, filed Jan. 5, 2018 (U.S. Publication No. 20180126294).

International Search Report and Written Opinion for International (PCT) Application No. PCT/US2018/012667, dated Jun. 20, 2018 (WO2018/129380).

International Search Report and Written Opinion for International (PCT) Application No. PCT/US2018/018418, dated May 2, 2018 (WO2018/152361).

International Preliminary Report on Patentability for International (PCT) Application No. PCT/US2018/018418, dated Aug. 29, 2019.

* cited by examiner

ROD-SHAPED MODULE FOR TOY MAGNETIC CONSTRUCTION KITS AND METHOD FOR MAKING SAME

CROSS-REFERENCE TO RELATED APPLICATIONS

The present application claims the benefit of U.S. Provisional Patent Application No. 62/459,238, filed on Feb. 15, 2017, which is incorporated by reference herein in its entirety.

FIELD OF THE INVENTION

The following disclosure relates to toy construction kits having magnetic modules, and, more particularly, to modules without magnets that may be used with modules having magnets in a toy magnetic construction kit.

BACKGROUND OF THE INVENTION

Magnetic construction kits have become a popular category of children's toys. These kits ordinarily include construction modules having magnets embedded in them that enable the modules to be connected to each other or to modules without magnets via magnetism. One such magnetic module is in the form of a rod-like body having a magnet in each end thereof. These modules can be combined with steel balls in various configurations to make larger structures, which have size restrictions due mainly to the weight of the steel balls. Using these modules, children are able to assemble many imaginative two-dimensional and three-dimensional shapes and structures, thereby imparting great enjoyment and entertainment to the children using them.

SUMMARY OF THE INVENTION

In accordance with the present invention, a module for toy construction kits is provided with an elongated body, which includes as a mid-section having one cross-sectional shape and a pair of opposed ends having cross-sectional shapes different from the cross-sectional shape of the mid-section. The body is made of a non-magnetic material, of which thermoplastic and thermosetting materials are examples. In an embodiment, the ends of the body have ferromagnetic covers, which can be in the form of thin-walled, dome-shaped shells. In an embodiment, each of the covers has a depression and an aperture through the depression. When, for instance, the module is made using a co-molding process, material from the body extends through the apertures into the depressions so as to secure the covers to the body. The result is an in integrated module that is relatively lightweight, thereby allowing users to assemble larger structures than can be made using conventional toy magnetic construction kits consisting of magnetic modules in combination with steel balls.

In an embodiment, each end of the body terminates in a ball or in a solid mass having some other three-dimensional shape. In an embodiment, the body tapers from its mid-section toward its ends to form necks, each ball being attached to or integral with the narrow end of its corresponding neck. In an embodiment, the ball is thicker or wider than the narrow end of the neck. In an embodiment, each cover includes two hemispherical domes which are joined to each other, or positioned in close proximity to one another, on diametrically opposed sides of their corresponding ball to thereby at least partially cover the ball.

BRIEF DESCRIPTION OF THE DRAWINGS

For a more complete understanding of the present invention, reference is made to the following detailed description of various exemplary embodiments considered in conjunction with the accompanying drawings, in which.

DETAILED DESCRIPTION OF THE EXEMPLARY EMBODIMENTS

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations disclosed herein.

All terms defined herein should be afforded their broadest possible interpretation, including any implied meanings as dictated by a reading of the specification as well as any words that a person having skill in the art and/or a dictionary, treatise, or similar authority would assign thereto. As used herein, the term "magnetic" shall mean a characteristic or feature of any element or part that allows such element or part to function as a magnet or, in the alternative, to be attracted to a magnet. The term "ferromagnetic", as used herein, shall mean an element or part which is at least partially made from iron and which is "magnetic", as that term is defined hereinabove.

Further, it should be noted that, as recited herein, the singular forms "a," "an," and "the" include the plural referents unless otherwise stated. Additionally, the terms "comprises" and "comprising" when used herein specify that certain features are present in that embodiment. However, this phrase should not be interpreted to preclude the presence of additional steps, operations, features, components, and/or groups thereof.

Figure 1:
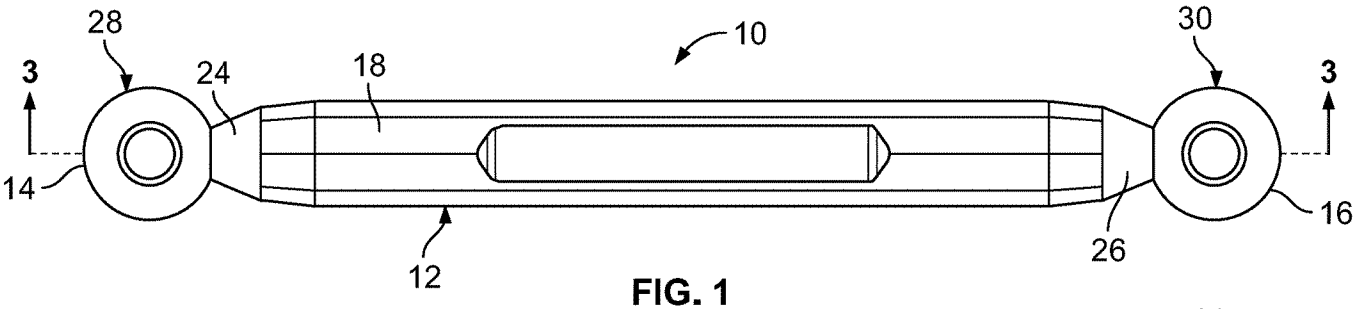
FIG. 1 is a top plan view of a rod-shaped module according to an embodiment of the present invention, which embodiment comprises an elongated body and four dome-shaped shells.
Figure 2:
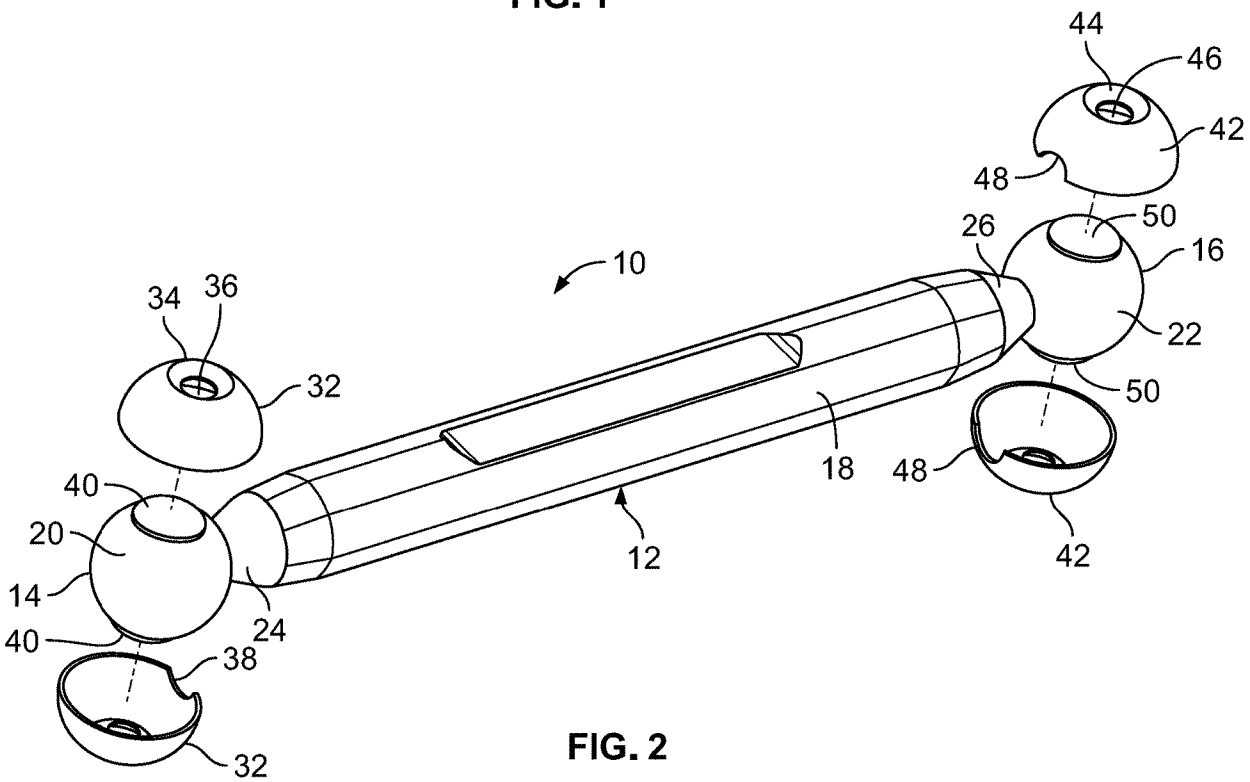
FIG. 2 is an exploded perspective view of the rod-shaped module of FIG. 1, which view depicts the four dome-shaped shells separated from the elongated body.
Figure 3:
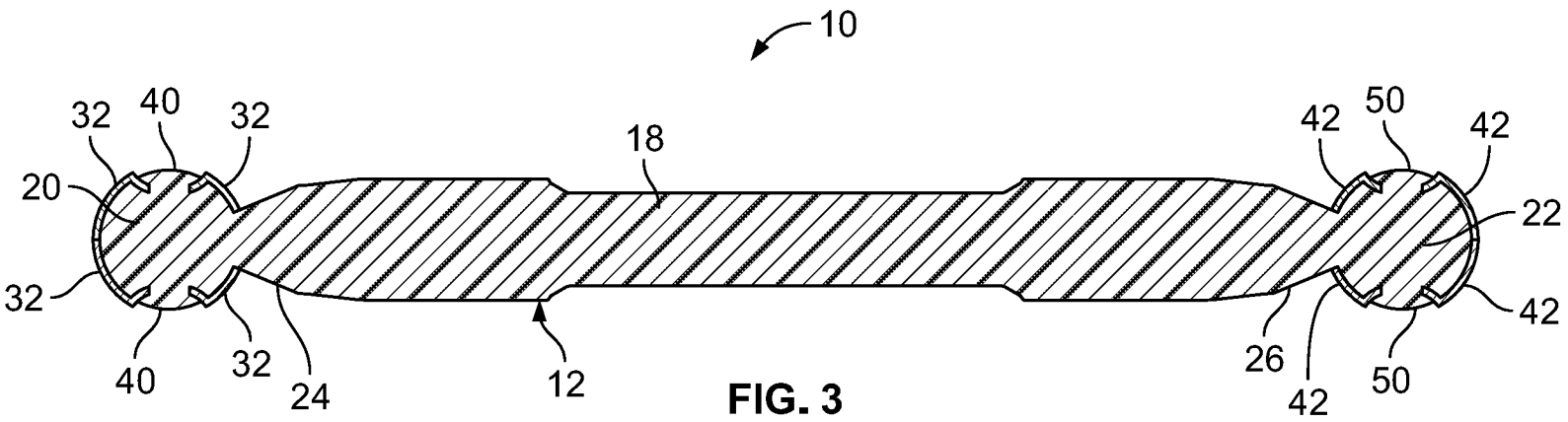
FIG. 3 is a cross-sectional view, taken along section line 3-3 in FIG. 1 and looking in the direction of the arrows, of the rod-shaped module of FIG. 1.

With reference to FIGS. 1-3, a rod-shaped module 10 according to the present invention has an elongated body 12 having a pair of opposed ends 14, 16 and a mid-section (i.e., central section) 18 between the ends 14, 16. In the exemplary embodiment, the elongated body 12 is made of a non-magnetic material. In an embodiment, the elongated body 12 has a monolithic (i.e., one-piece) construction and is made of a non-magnetic material suitable for injection or insert molding. Thermoplastic polymers and thermosetting polymers are examples of such non-magnetic materials.

In the exemplary embodiment of FIGS. 1-3, each of the ends 14, 16 of the elongated body 12 terminates in a spherical ball 20, 22, respectively (see especially, FIG. 2). In other embodiments of the present invention, the ends 14, 16 terminate with three-dimensional solid structures having shapes other than spherical. For example, the elongated body 12 may terminate in a solid mass of non-magnetic material having a conical shape, a prismatic shape, an oblate spheroid, or some other three-dimensional shape. In yet other embodiments of the present invention, the ends 14, 16 of the elongated body 12 do not terminate in a three-dimensional solid structure. For example, the ends 14, 16 of the elongated body 12 may terminate in a flat or rounded surface. In embodiments of the present invention, the spherical balls 20, 22, or other three-dimensional solid structures, may have a thickness that is less than the thickness of the mid-section 18. In other embodiments of the present invention, the spherical balls 20, 22, or other three-dimensional solid structures, may have a thickness that is the same as the thickness of the mid-section 18. In embodiments of the present invention, the spherical balls 20, 22, or other three-dimensional solid structures, may have a thickness that is greater than the thickness of the mid-section 18.

In the exemplary embodiment of FIGS. 1-3, the elongated body 12 has a pair of conical neck sections 24, 26, each of which is tapered to become progressively more narrow toward the ends 14, 16, respectively, of the elongated body 12. In the exemplary embodiment, both the widest and most narrow portions of the neck sections 24, 26 have diameters that are less than the diameter of the spherical balls 20, 22. In other embodiments, the elongated body 12 does not have any neck sections, tapered or otherwise.

In the exemplary embodiment of FIGS. 1-3, the ends 14, 16 of the elongated body 12 have ferromagnetic covers 28, 30, respectively, (see FIG. 1) that cover at least a portion of the spherical balls 20, 22, respectively. In embodiments of the present invention, the ferromagnetic covers 28, 30 are thin-walled shells made from a magnetically-attractable material and having shapes closely fitting (i.e., matching) the outer surface of the spherical balls 20, 22, respectively, or whatever other three-dimensional structure is located at the ends 14, 16 of the elongated body 12. In embodiments of the present invention that do not terminate in the spherical balls 20, 22, or in another three-dimensional structure at the ends 14, 16 of the elongated body 12, a ferromagnetic cover (not shown) is applied to each of the ends 14, 16 of the elongated body 12. Examples of such ferromagnetic covers, which are not shown, include a band around the perimeter of the elongated body 12 at each of its ends 14,16, and/or a cap that covers each of the ends 14, 16 of the elongated body 12. In other embodiments, a thin ferromagnetic cover (not shown) may be provided on any accessible part(s) of the elongated body 12. A person having ordinary skill in the art and possession of the present disclosure will recognize the utility of closely fitting any such ferromagnetic cover(s) to the portion(s) of the elongated body 12 to be covered, and will recognize the materials and methods that are suitable for making such ferromagnetic covers, even though they are not shown herein.

Figure 4:
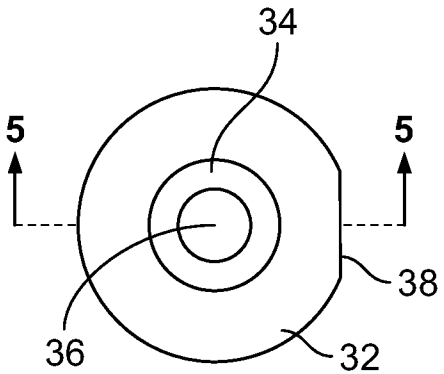
FIG. 4 is a top plan view of one of the dome-shaped shells forming a component part of the rod-shaped module of FIGS. 1-3.
Figure 5:
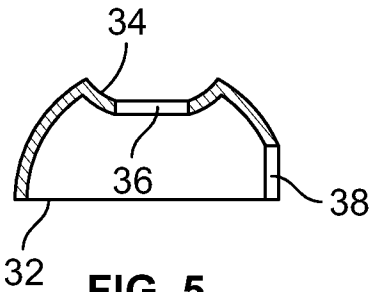
FIG. 5 is a cross-sectional view, taken along section line 5-5 in FIG. 4 and looking in the direction of the arrows, of the dome-shaped shell of FIG. 4.

With continuing reference to FIGS. 1-3, but with particular reference to FIGS. 4 and 5, the ferromagnetic cover 28 comprises a pair of identical ferromagnetic domes 32, 32, which are hemispherical in shape and which cooperate with each other so that they combine to form the ferromagnetic cover 28. As shown most clearly in FIGS. 4 and 5, each of the ferromagnetic domes 32, 32 has a depression 34 that is concave relative to the generally convex shape of the ferromagnetic domes 32, 32. Further, each of the ferromagnetic domes 32, 32 has an aperture 36 in communicating alignment with its respective depression 34 and extending through the dome's wall from its inner wall to its outer wall. Further yet, each of the ferromagnetic domes 32, 32 has a respective notch 38 arranged to fit against an adjacent portion of the neck section 24. In the assembled rod-shaped module 10, the material of the elongated body 12 extends through the aperture 36 in each of the domes 32, 32 and into its respective depression 34, thereby forming plugs 40 (see especially FIG. 3), which function to secure the ferromagnetic domes 32, 32 to the elongated body 12. One having ordinary skill in the art and possession of the present disclosure will recognize practical adaptations of this arrangement of depressions, apertures, and plugs for securing covers having geometries other than spherical to an elongated body of the present invention.

Referring to FIGS. 1-3, but with indirect reference to FIGS. 4 and 5, the ferromagnetic cover 30 comprises a pair of ferromagnetic domes 42, 42 which are identical to each other and to the domes 32, 32. Thus, the domes 42, 42 are hemispherical in shape and they cooperate with each other to form the ferromagnetic cover 30. As shown most clearly in FIG. 2, each of the ferromagnetic domes 42, 42 has a depression 44 that is concave relative to the generally convex shape of the ferromagnetic domes 42, 42. Further, each of the ferromagnetic domes 42, 42 has an aperture 46 in communicating alignment with its respective depression 44 and extending through the dome's wall from its inner wall to its outer wall. Further yet, each of the ferromagnetic domes 42, 42 has a respective notch 48 arranged to fit against an adjacent portion of the neck section 26. In the assembled rod-shaped module 10, the material of the elongated body 12 extends through the aperture 46 in each of the domes 42, 42 and into its respective depression 44, thereby forming plugs 50 (see especially FIG. 3), which function to secure the ferromagnetic domes 42, 42 to the elongated body 12. Once again, it is noted that one having ordinary skill in the art and possession of the present disclosure will recognize practical adaptations of this arrangement of depressions, apertures, and plugs for securing covers having geometries other than spherical to an elongated body of the present invention.

The rod-shaped module 10 may be made by an injection or insert molding process, according to an exemplary embodiment of the present invention. In such a process, the ferromagnetic domes 32, 32 and 42, 42 are placed into a mold at positions that correspond to their desired locations on the rod-shaped module 10 (e.g., as the ferromagnetic covers 28, 30 which at least partially cover the spherical balls 20, 22, respectively). The material for the elongated body 12 is injected into the mold so that some of the material flows through the apertures 36, 46 and into their respective depressions 34, 44, thereby forming the plugs 40, 50, respectively (see especially FIG. 3), which function to secure the ferromagnetic domes 32, 32 and 42, 42 to the elongated body 12. One having ordinary skill in the art and possession of the present disclosure will recognize that the foregoing method may be modified or varied to make modules that are rod-shaped, as well as modules having other shapes, with various types (e.g., sizes and shapes) of ferromagnetic covers.

The rod-shaped module 10 of the present invention can be used in conjunction with the magnetized components of other toy magnetic construction kits, such that the rod-like module 10 provides the same structural features as the combination of rod-like magnetic construction modules and steel balls that has been discussed above. Moreover, the rod-shaped module 10 weighs much less than the combination of a rod-like magnetic construction module and a steel ball at each end of the rod-shaped magnetic module, thereby allowing much larger structures to be assembled using the rod-shaped module 10.

All examples and conditional language recited herein are intended for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It will be understood that the embodiments described herein are merely exemplary and that a person skilled in the art may make many variations and modifications without departing from the spirit and scope of the invention. For example, the rod-shaped module 10 may be manufactured in a variety of different dimensional sizes, such as lengths, widths and thicknesses. All such variations and modifications are intended to be included within the scope of the invention.

We claim:

1. A module for a toy construction kit, said module comprising:

an elongated, monolithic body made entirely from a non-magnetic material, said body extending continuously along an imaginary central longitudinal axis of said body and having a central section with a first lateral cross-sectional shape, a pair of opposed ends, each of which has a second lateral cross-sectional shape different from said first lateral cross-sectional shape, a first end of said pair of opposed ends having a first hemi-spherical surface laterally offset relative to one side of the imaginary central longitudinal axis of said body and a second hemi-spherical surface laterally offset relative to an opposite side of the imaginary central longitudinal axis of said body, and a second end of said pair of opposed ends having a third hemi-spherical surface laterally offset relative to said one side of the imaginary central longitudinal axis of said body and a fourth hemi-spherical surface laterally offset relative to said opposite side of the imaginary central longitudinal axis of said body, and a pair of tapered neck sections, one of said neck sections connecting said central section of said body to said first end of said body and the other of said neck sections connecting said central section of said body to said second end of said body;

a plurality of dome-shaped shells made from a magnetic material, said plurality of dome-shaped shells including a first pair of dome-shaped shells positioned on said first end of said body so as to at least partially cover said first and second hemi-spherical surfaces of said first end of said body, said first pair of dome-shaped shells including a first dome-shaped shell positioned on said first hemi-spherical surface and a second dome-shaped shell positioned on said second hemi-spherical surface, and a second pair of dome-shaped shells positioned on said second end of said body so as to at least partially cover said third and fourth hemi-spherical surfaces of said second end of said body, said second pair of dome-shaped shells including a third dome-shaped shell positioned on said third hemi-spherical surface and a fourth dome-shaped shell positioned on said fourth hemi-spherical surface, each shell of said first pair of dome-shaped shells and each shell of said second pair of dome-shaped shells having a hemi-spherical inner wall, a hemi-spherical outer wall, an aperture extending between said inner and outer hemi-spherical walls and an annular depression in said hemi-spherical outer wall extending circumferentially around said aperture;

a first pair of plugs formed from said non-magnetic material as part of said first end of said body, one plug of said first pair of plugs extending through said aperture of said first dome-shaped shell and filling said depression in said first dome-shaped shell to thereby secure said first dome-shaped shell to said first end of said body, and the other plug of said first pair of plugs extending through said aperture of said second dome-shaped shell and filling said depression in said second dome-shaped shell to thereby secure said second dome-shaped shell to said first end of said body; and a second pair of plugs formed from said non-magnetic material as part of said second end of said body, one plug of said second pair of plugs extending through said aperture of said third dome-shaped shell and filling said depression in said third dome-shaped shell to thereby secure said third dome-shaped shell to said second end of said body, and the other plug of said second pair of plugs extending through said aperture of said fourth dome-shaped shell and filling said depression in said fourth dome-shaped shell to thereby secure said fourth dome-shaped shell to said second end of said body.

2. The module of claim 1, wherein said central section of said body, said pair of tapered neck sections of said body, and said pair of opposed ends of said body are arranged coaxially relative to the imaginary central longitudinal axis of said body.

3. The module of claim 2, wherein each shell of said first pair of dome-shaped shells has a notch sized and shaped so as to receive a portion of said one neck section, and each shell of said second pair of dome-shaped shells has a notch sized and shaped so as to receive a portion of said other neck section.

4. The module of claim 3, wherein said neck section tapers such that it is thinnest at a point adjacent said first end of said body, and said other neck section tapers such that it is thinnest at a point adjacent said second end of said body.

5. The module of claim 1, wherein each shell of said plurality of dome-shaped shells is made from a magnetically-attractable material.

6. The module of claim 1, wherein each shell of said plurality of dome-shaped shells functions as a magnet.

7. The module of claim 1, wherein said non-magnetic material is a polymer selected from the group consisting essentially of a thermoplastic polymer and a thermosetting polymer.

8. The module of claim 1, wherein said module is manufactured by co-molding of said plurality of dome-shaped shells with said body.

9. The module of claim 1, wherein said second lateral cross-sectional shape is spherical.

10. The module of claim 9, wherein said first lateral cross-sectional shape of said central section of said body defines a thickness of said central section and said first and second ends of said body have a diameter which is greater than said thickness of said central section.

11. The module of claim 9, wherein each shell of said plurality of dome-shaped shells has an apogee.

12. The module of claim 11, wherein said aperture and said depression of each shell of said plurality of dome-shaped shells is located generally at said apogee.

13. The module of claim 1, wherein each neck section of said pair of tapered neck sections has a third lateral cross-sectional shape different from said first and second lateral cross-sectional shapes.

14. The module of claim 13, wherein said each neck section of said pair of tapered neck sections has a frusto-conical shape.

* * * * *